United States Patent [19]

Otobe et al.

[11] Patent Number: 4,542,728

[45] Date of Patent: Sep. 24, 1985

[54] METHOD FOR CONTROLLING FUEL SUPPLY TO INTERNAL COMBUSTION ENGINES HAVING CATALYTIC MEANS FOR PURIFYING EXHAUST GASES, AT OPERATION IN A HIGH SPEED REGION

[75] Inventors: Yutaka Otobe, Shiki; Noriyuki Kishi, Tokyo, both of Japan

[73] Assignee: Honda Giken Kogyo Kabushiki Kaisha, Tokyo, Japan

[21] Appl. No.: 502,105

[22] Filed: Jun. 8, 1983

[30] Foreign Application Priority Data

Jun. 15, 1982 [JP] Japan ..... 57-102652

[51] Int. Cl.[4] ..... F02B 3/00; F01N 3/20

[52] U.S. Cl. ..... 123/440; 60/277; 123/492

[58] Field of Search ..... 123/492, 440, 489; 60/277

[56] References Cited

U.S. PATENT DOCUMENTS

| | | | |
|---|---|---|---|
| 4,052,968 | 10/1977 | Hattori | 123/440 |
| 4,075,982 | 2/1978 | Asano | 123/440 |
| 4,088,095 | 5/1978 | Aono | 123/440 |
| 4,107,920 | 8/1978 | Minami | 123/440 |
| 4,119,072 | 10/1978 | Asano | 123/440 |
| 4,121,554 | 10/1978 | Sueishi | 123/440 |
| 4,123,901 | 11/1978 | Masaki | 60/277 |
| 4,240,389 | 12/1980 | Shimazaki | 123/440 |
| 4,279,230 | 7/1981 | Bauer | 123/440 |
| 4,319,451 | 3/1982 | Tajima | 60/277 |
| 4,375,210 | 3/1983 | Ohara | 123/440 |
| 4,388,903 | 6/1983 | Yoshida | 123/440 |

*Primary Examiner*—Ronald B. Cox
*Attorney, Agent, or Firm*—Lyon & Lyon

[57] ABSTRACT

A fuel supply control method for controlling the quantity of fuel being supplied to an internal combustion engine having a catalytic means for purifying detrimental ingredients in exhaust gases, in a feedback manner responsive to the output of a means for detecting the concentration of an ingredient in the exhaust gases. When the engine is operating in a predetermined high speed operating region wherein the rotational speed of the engine is higher than a predetermined speed, the above feedback control is interrupted and the fuel quantity is increased by a predetermined amount so as to make the air/fuel ratio of a mixture being supplied to the engine richer than a theoretical mixture ratio. Preferably, the above predetermined speed is set at a value which is a maximum value of rpm above which the catalyst bed temperature of the exhaust gas purifying means will exceed a predetermined maximum allowable value, if the air/fuel ratio is controlled to the theoretical mixture ratio or a value close thereto. Further, preferably, the above predetermined fuel amount by which the fuel quantity is increased in the above predetermined high speed operating region is set to larger values as the intake pipe absolute pressure increases.

3 Claims, 10 Drawing Figures

| FIG. 3A | FIG. 3B |
|---|---|

START

1
No
KWOT = 1 ?
Yes
3
No
Ne > NHOP ?
Yes
4
READ OUT KCATi FROM KCAT TABLE CORRESPONDING TO PBA
2
SET KCAT TO 1.0
END

KCAT
KCAT3
KCAT2
KCAT1
1.0
PBA1 (PCAT)
PBA2
PBA3
PBA mmHg abs
INTAKE PASSAGE PRESSURE

METHOD FOR CONTROLLING FUEL SUPPLY TO INTERNAL COMBUSTION ENGINES HAVING CATALYTIC MEANS FOR PURIFYING EXHAUST GASES, AT OPERATION IN A HIGH SPEED REGION

BACKGROUND OF THE INVENTION

This invention relates to a fuel supply control method for internal combustion engines equipped with catalytic means for purifying exhaust gases, and more particularly to a method of this kind which is adapted to prevent an abnormal increase in the catalyst bed temperature of the catalytic means when the engine is operating in a certain high speed operating region.

A fuel supply control system adapted for use with an internal combustion engine, particularly a gasoline engine has been proposed e.g. by U.S. Pat. No. 3,483,851, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

Also, in an engine having a three-way catalyst or a like catalytic means arranged in its exhaust system, it is generally employed to control the air/fuel ratio of the mixture to a theoretical mixture ratio in a feedback manner responsive to the output of an exhaust gas concentration sensor which may be represented by an $O_2$ sensor, arranged in the exhaust system of the engine, to obtain the best conversion efficiency of unburned hydrocarbons, carbon monoxide and nitrous oxides in the exhaust gases emitted from the engine.

However, this feedback control based upon the output of the exhaust gas sensor cannot be applied when the engine is operating in a particular operating condition where the air/fuel ratio of the mixture needs to be controlled to a value different from the theoretical mixture ratio.

For instance, when the engine is operating in a certain high speed region, if the engine is operated with the air/air fuel ratio of the mixture controlled to the theoretical mixture ratio or a value close thereto, the bed temperature of the three-way catalyst arranged in the exhaust system of the engine can abruptly increase above a maximum allowable temperature. The rate of such increase in the bed temperature of the three-way catalyst can become higher with an increase in the intake pipe absolute pressure PBA. That is, if an air/fuel mixture having a theoretical mixture ratio or a value close thereto is supplied to the engine while the engine is operating in the above certain high speed region, the efficiency of combustion within the engine cylinders will become higher to increase the heat generated per unit mass of the air/fuel mixture, thereby increasing the temperature of the exhaust gases flowing through the three-way catalyst. Also, the higher the temperature of the exhaust gases, the higher the reaction rate of the three-way catalyst with the exhaust gas ingredients, and the resultant increased reaction heat causes the bed temperature of the catalyst to rise. Further, as the quantity of exhaust gases per unit volume of the catalyst increases, the catalyst bed temperature increases. Thus, as the exhaust gases increase in both quantity and temperature or catalytic reaction rate, the caltalyst bed temperature abruptly increases. Therefore, when the engine is operating in a high speed region, especially with a high engine load wherein the exhaust gas quantity is large, the catalyst bed temperature can easily exceed a maximum allowable temperature.

SUMMARY OF THE INVENTION

It is the object of the invention is to provide a fuel supply control method for an internal combustion engine equipped with a catalytic means for purifying the exhaust gas ingredients, which is adapted to maintain the bed temperature of the catalytic means below its maximum allowable temperature, even when the engine is operating in a certain high speed operating region, to thereby prolong the service life of the catalytic means and consequently ensure maintaining required emission characteristics of the engine.

According to the invention, there is provided a fuel supply control method for controlling the quantity of fuel being supplied to an internal combustion engine having a catalytic means for purifying detrimental ingredients in exhaust gases emitted from the engine, in a feedback manner responsive to an output from a means for detecting the concentration of an ingredient in the exhaust gases. The method according to the invention is characterized by comprising the following steps: (1) determining whether or not the engine is operating in a predetermined high speed operating region wherein the rotational speed of the engine is higher than a predetermined speed; and (2) interrupting the above feedback control and increasing the quantity of fuel being supplied to the engine by a predetermined amount, so that the resultant air/fuel mixture being supplied to the engine has an air/fuel ratio richer than a theoretical mixture ratio, when it is determined in the step (1) that the engine is operating in the above predetermined high speed operating region.

Preferably, the above predetermined speed is set at a value which is a maximum value of rpm above which the bed temperature of the catalytic means, which increases with an increase in the engine rotational speed, will exceed a predetermined maximum allowable value, if the air/fuel ratio is controlled to the theoretical mixture ratio or a value close thereto. Also preferably, the above predetermined high speed operating region is also defined as a region wherein the absolute pressure in an intake passage of the engine is higher than a predetermined value. The predetermined engine rotational speed and the predetermined intake passage absolute pressure, which are thus applied for determination of the operating condition of the engine in the above predetermined high speed operating region, are each set to different values between when the operating condition of the engine enters the predetermined high speed operating region and when it leaves the same operating region, to thereby ensure stable operation of the engine. Further, preferably, the above predetermiend fuel amount by which the fuel quantity is increased in the above predetermined high speed operating region in the aforementioned step (2) is set to larger values as the intake pipe absolute pressure increases.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
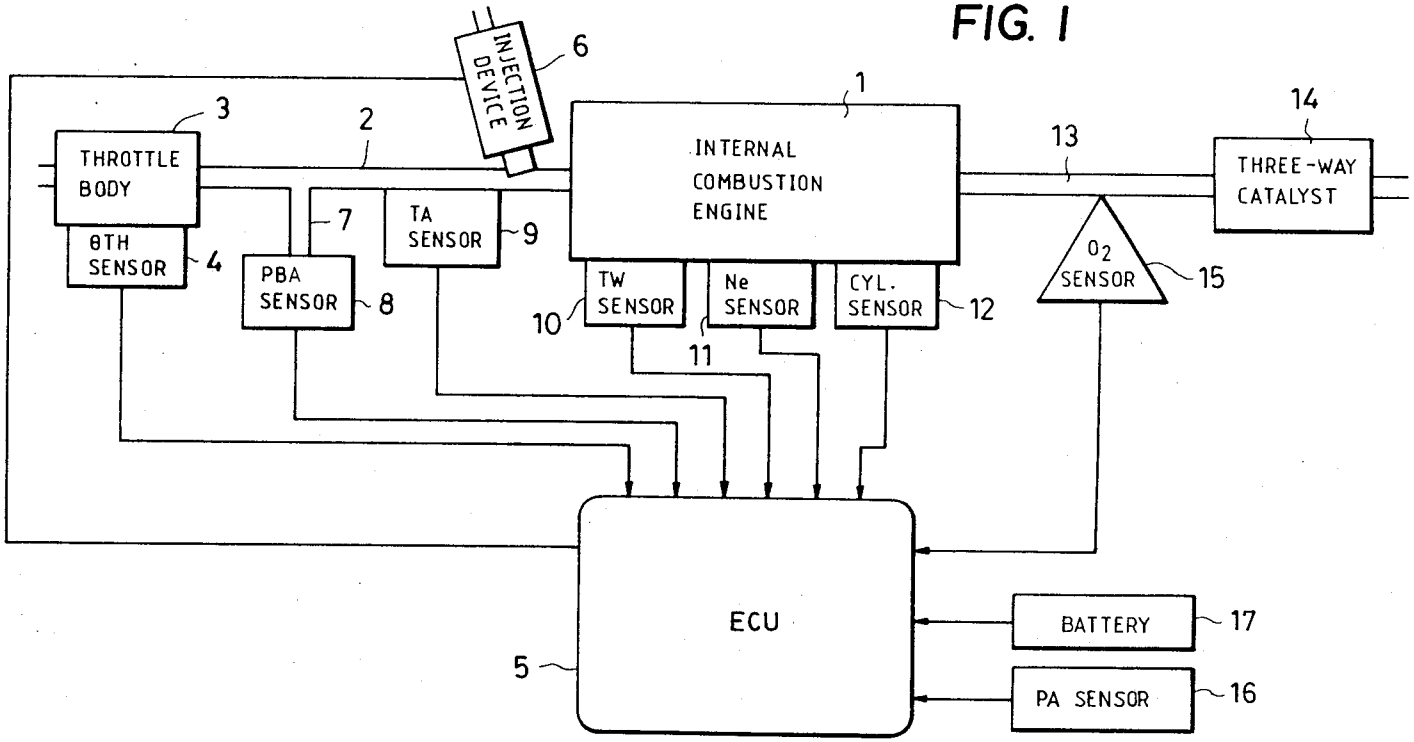
FIG. 1 is a block diagram illustrating the whole arrangement of a fuel supply control system to which is applicable the method according to the present invention.

Referring first to FIG. 1, there is illustrated the whole arrangement of a fuel supply control system for internal combustion engines, to which the method of the present invention is applicable. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 as a fuel quantity metering means is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The fuel injection device is connected to a fuel pump, not shown. The main injectors and the subinjector of the fuel injection device 6 are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature sensor 9 is arranged in the intake pipe 2 at a location downstream of the absolute pressure sensor 8 and also electrically connected to the ECU 5 for supplying same with an electrical signal indicative of detected intake-air temperature.

An engine cooling water temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure for supplying the ECU 5 with an electrical signal indicative of detected atmospheric pressure and a battery 17 for supplying the ECU 5 with electric power.

The ECU 5 operates on the various engine operation parameter signals stated above, inputted thereto to determine the valve opening periods TOUTM and TOUTS for the main injectors and the subinjector which are driven in synchronism with generation of pulses of the TDC signal, by the use of the following equations (1) or (1') and (2):

$$TOUTM = TiM \times K_1 + K_2 \quad (1)$$

or $$TOUTM = TiM \times K1, + K2, \quad (1')$$

$$TOUTS = TiS \times K_3 + K_4 \quad (2)$$

where TiM and TiS represent the basic fuel injection periods of the main injectors and the subinjector, each of which is read from a storage means within the ECU 5, as a function of the intake pipe absolute pressure PBA and the engine rpm Ne, and $K_1$, K1′ and $K_3$ and $K_2$, K2′ and $K_4$ represent correction coefficients and correction values, respectively, the values of which are calculated on the basis of engine operation parameter signals from the aforementioned various sensors so as to achieve optimum operating characteristics of the engine such as fuel consumption and accelerability.

The correction coefficient $K_1$ is determined from the following equation in the form of a product of a mixture-enriching coefficient KCAT applicable at operation of the engine in a predetermined high speed operating region as described later, an "$O_2$ sensor output-dependent feedback control" correction coefficient $KO_2$, an intake air temperature-dependent correction coefficient KTA, an engine cooling water temperature-dependent correction coefficient KTW, an after-fuel cut fuel quantity increasing coefficient KAFC, a mixture-enriching coefficient KWOT applicable at wide-open-throttle, and a mixture-leaning coefficient KLS applible at operation of the engine in a predetermined mixture-leaning region:

$$K_1 = KCAT \times KO_2 \times KTA \times KTW \times KAST \times KAFC \times KWOT \times KLS \quad (3)$$

The correction value $K_2$ is determined from the following equation in the form of the sum of a product of a fuel quantity increasing value TACC applicable at acceleration of the engine, the above-mentioned coefficient KTA, a water temperature-dependent fuel quantity increasing coefficient KTWT applicable at acceleration and post-acceleration of the engine, and a fuel quantity increasing coefficient KTAST applicable immediately after the start of the engine, and a battery voltage-dependent correction value TV and a correction coefficient ΔTV whose value is set in dependence on the operating characteristics of individual injectors:

$$K_2 = TACC \times (KTA \times KTWT \times KTAST) + (TV + \Delta TV) \quad (4)$$

When the engine is operating in the aforementioned predetermined high speed operating region, the correction coefficient KCAT, the value of which is calculated as hereinafter described, is applied to the equation (1) so as to increase the quantity of fuel being supplied to the engine.

Alternatively of the equation (1) may be used the equation (1′). In this equation (1′), the values of the coefficient K1′ and the value K2′ are calculated by the use of the following equations:

$$K1' = KO_2 \times KTA \times KTW \times KTAST \times KAFC \times KWOT \times KLS \quad (5)$$

$$K2' = TACC \times (KTA \times KTWT \times KTAST) + (TV + \Delta TV) + TCAT \quad (6)$$

where TCAT is a mixture-enriching value applicable at operation of the engine in the aforementioned predetermined high speed operating region.

The ECU 5 calculates the fuel injection periods TOUTM, TOUTS for the injectors, by the use of the equations (1) and (2) or (1′) and (2), and generates driving signals for causing the main injectors and the subinjector to open with duty factors corresponding to the calculated fuel injection periods.

Figure 2:
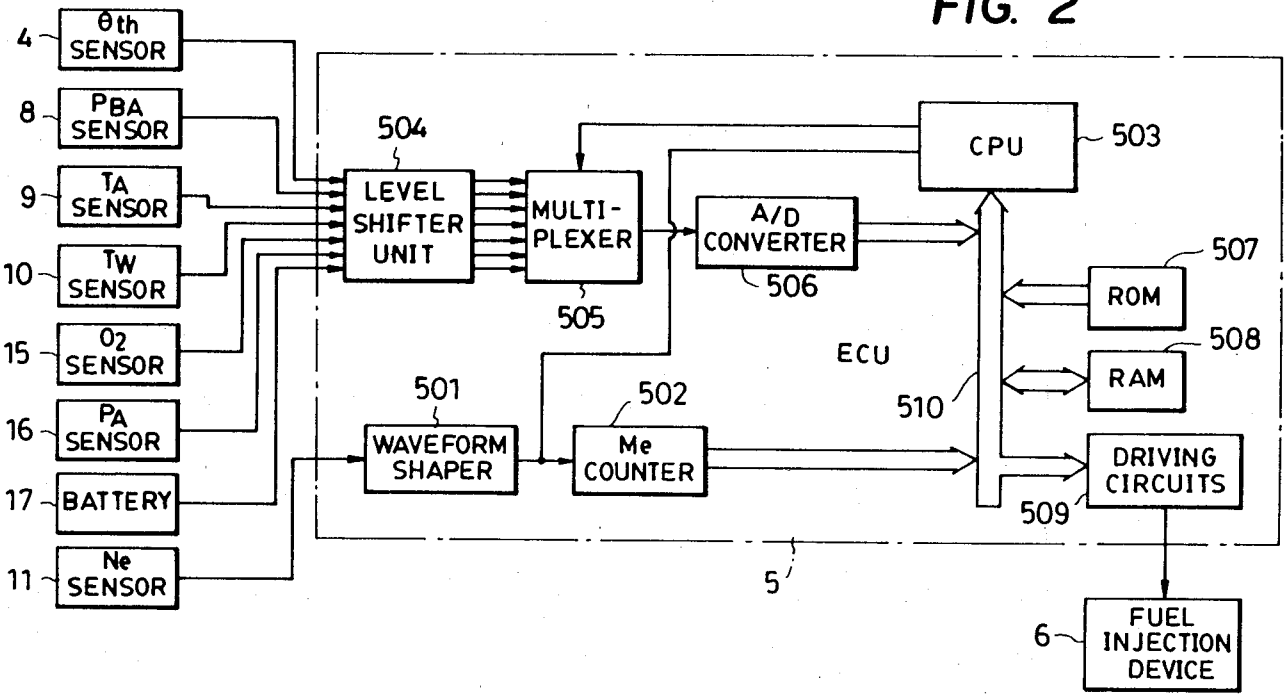
FIG. 2 is a circuit diagram showing an electrical circuit within the electronic control unit (ECU) 5 in FIG. 1.

FIG. 2 is a block diagram showing an electrical circuit within the ECU 5 in FIG. 1. The engine rpm signal from the Ne sensor 11 in FIG. 1 is applied to a waveform shaper 501, wherein it has its pulse waveform shaped, and supplied to an Me value counter 502 as well as to a central processing unit (hereinafter called "CPU") 503 as a TDC signal. The Me value counter 502 counts the interval of time between a preceding pulse of the engine rpm signal generated at a predetermined crank angle of the engine and a present pulse of the same signal generated at the predetermined crank angle, inputted thereto from the Ne sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening sensor 4, the absolute pressure sensor 8, the intake air temperature sensor 9, the Ne sensor 11, the $O_2$ sensor 15, the atmospheric pressure sensor 16 and the battery 17, all appearing in FIG. 1, have their voltage levels shifted to a predetermined voltage level by a level shifter unit 504 and applied successively to an analog-to-digital converter (hereinafter called "A/D converter") 506 through a multiplexer 505 which operates on a command signal from the CPU 503. The A/D converter 506 successively converts the above signals into digital signals and supplies them to the CPU 503 via the data bus 510.

The CPU 503 is also connected to a read-only memory (hereinafter called "ROM") 507, a random access memory (hereinafter called "RAM") 508, and driving circuits 509, through the data bus 510. The ROM 507 stores a control program executed within the CPU 503, data of basic values TiM, TiS of fuel injection periods for the main injectors and the sub injector, data of the correction coefficients and correction values, etc. while the RAM 508 temporarily stores the resultant values of various calculations from the CPU 503. The CPU 503 executes the control program stored in the ROM 507 in synchronism with generation of the TDC signal to read values of the above coefficients and correction values corresponding to the output signals from the above various sensors, from the ROM 507, and calculate the valve opening periods TOUTM, TOUTS for the main injectors and the subinjector by applying to the aforementioned equations, the read values of the aforementioned coefficients and correction values, and supply the calculated TOUTM and TOUTS values to the driving circuits 509 via the data bus 510. The driving circuits 509 supply driving signals corresponding to the above TOUTM and TOUTS values to the main injectors and the subinjector to energize same.

Figures 3, 3B:
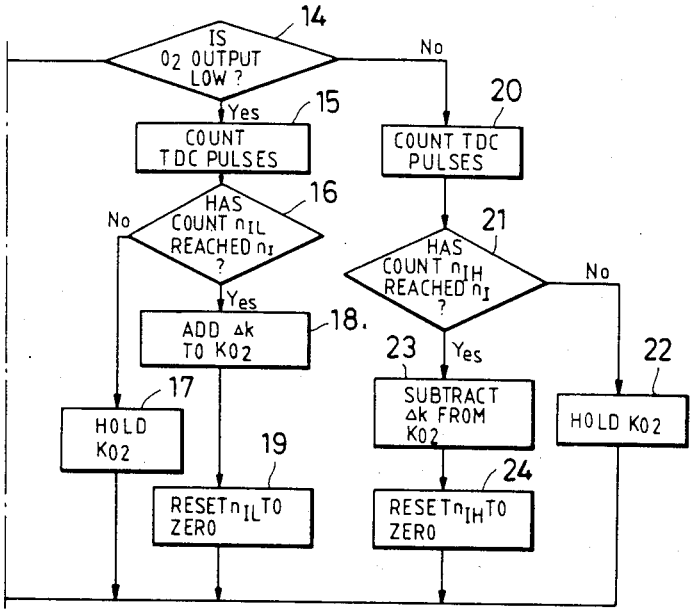
FIGS. 3, 3A, and 3B are flow charts showing a subroutine for calculating an air/fuel ratio correction coefficient $KO_2$.
Figure 3A:
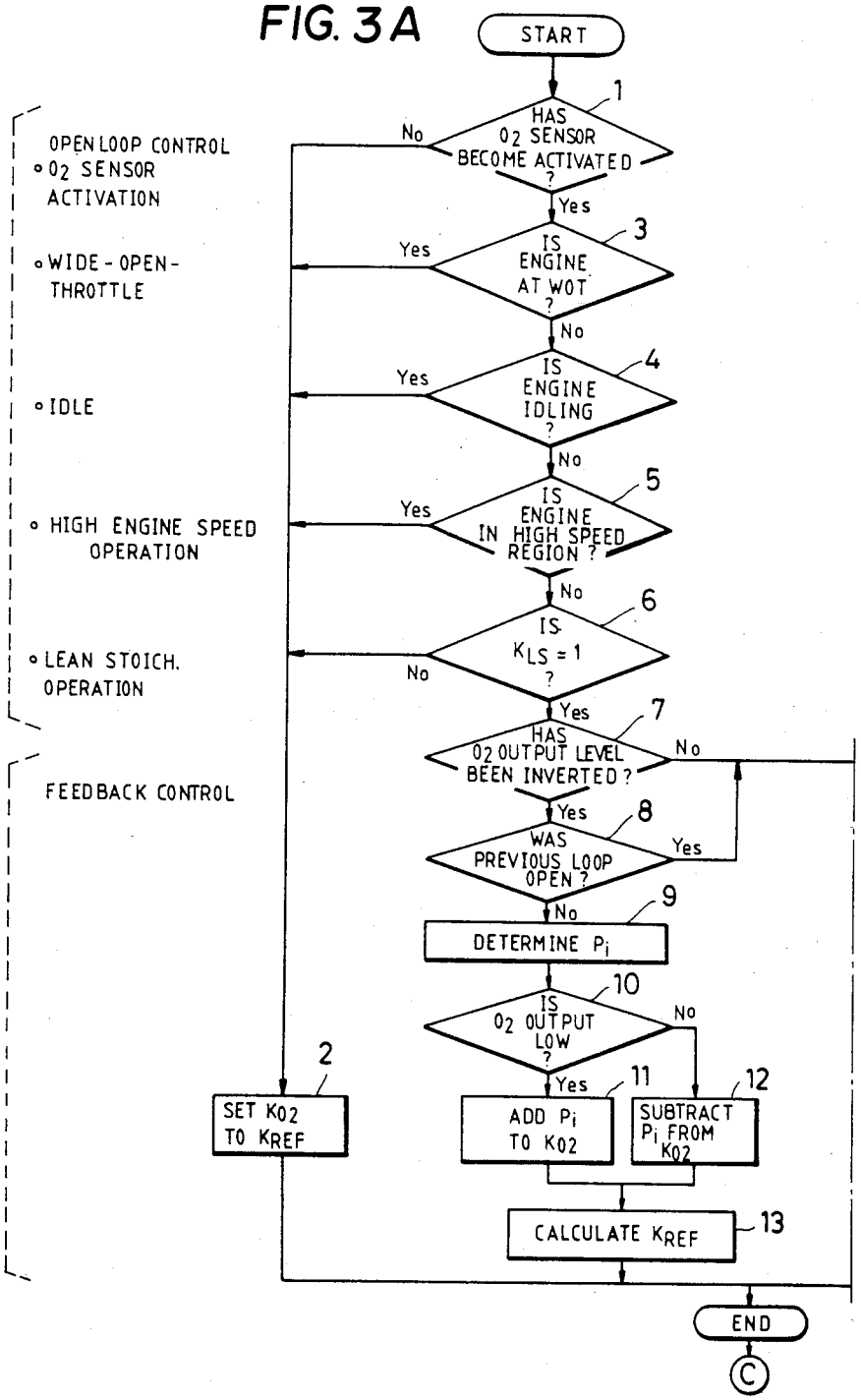

FIG. 3 shows a flow chart of a subroutine for calculating the $O_2$ sensor output-dependent correction coefficient $KO_2$, and determining the particular operating regions of the engine.

Figure 4:
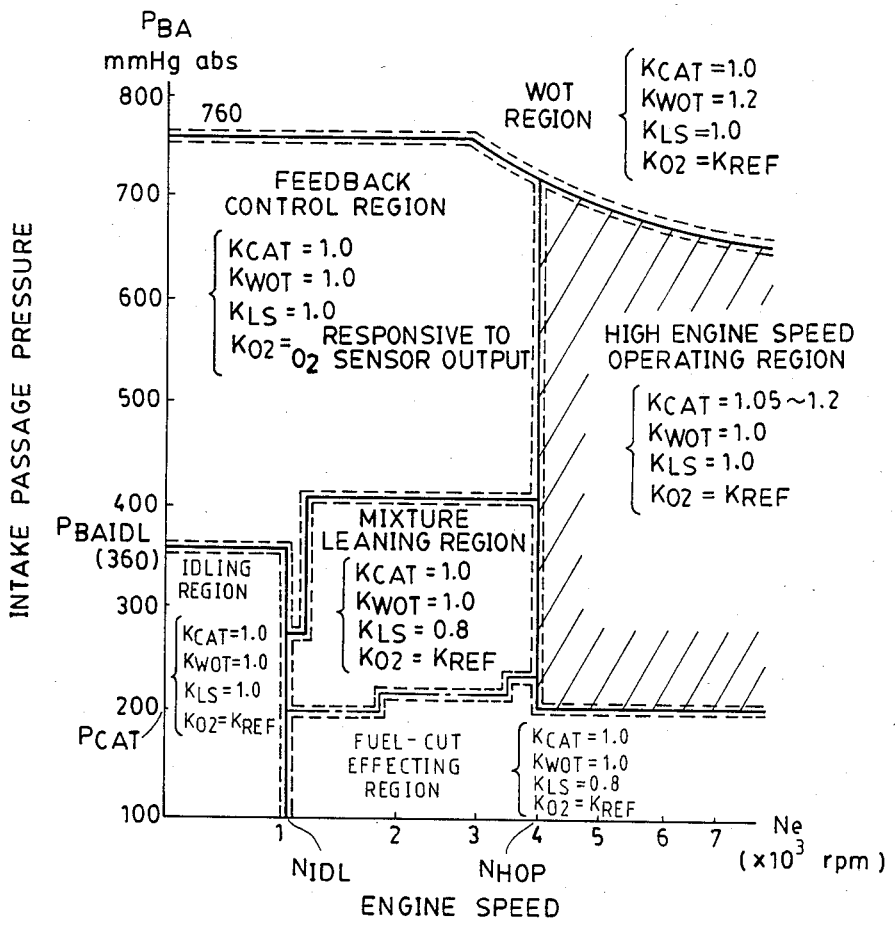
FIG. 4 is a graph showing a manner of applying correction coefficients to various operating regions of the engine.

First, a determination is made as to whether or not the $O_2$ sensor has become activated, at the step 1. More specifically, by utilizing the internal resistance of the $O_2$ sensor, it is detected whether or not the output voltage of the $O_2$ sensor has dropped to an initial activation point VX (e.g. 0.6 volt). Upon the point VX being reached, an activation-indicative signal is generated which actuates an associated activation delay timer to start counting a predetermined period of time (e.g. 60 seconds). At the same time, it is determined whether or not the water temperature-dependent fuel quantity increasing coefficient KTW and the after-start fuel quantity increasing coefficient KAST both are equal to 1. If all the above conditions are found to be fulfilled, it is then determined that the $O_2$ sensor has been activated. If the activation of the $O_2$ sensor is negated at the step 1, the value of the correction coefficient $KO_2$ is set to a mean value KREF, referred to later, which has been obtained in the last feedback control operation based on the $O_2$ sensor output, at the step 2. When the $O_2$ sensor is found to be activated, a determination is made as to whether or not the throttle valve is fully opened (wide-open-throttle), at the step 3. FIG. 4 is a graph showing various particular operating regions of the engine which are each determined by engine rpm Ne and intake pipe absolute pressure PBA. The above determination as to whether or not the throttle valve is fully opened is made on the basis of throttle valve opening and intake pipe absolute pressure. If the answer to the question of the step 3 is affirmative, the value of $KO_2$ is also set to the above mean value KREF. If the throttle valve is not fully opened, whether or not the engine is at idle is determined at the step 4. To be concrete, if the engine rpm Ne is smaller than a predetermined value NIDL (e.g. 1000 rpm) and the absolute pressure PBA is lower than a predetermined value PBAIDL (e.g. 360 mmHg), the engine is judged to be idling, and then the above step 2 is executed to set the $KO_2$ value to the value KREF. If the engine is not found to be idling, whether or not the engine is operating in the aforementioned predetermined high speed operating region is determined at the step 5. If the engine rpm Ne is larger than a predetermined value NHOP (e.g. 4,000 rpm) and preferably the intake pipe absolute pressure PBA is larger than a predetermined value PCAT (e.g. 200 mmHg), it is determined that the engine is operating in such predetermined high speed operating region, and then the value of the correction coefficient $KO_2$ is set to the above value KREF, at the step 2. On the other hand, when the engine is determined not to be in such predetermined high speed operating region, whether or not the aforementioned mixture-leaning coefficient KLS assumes a value of 1.0 is determined at the step 6. The value of the mixture-leaning coefficient KLS is set to 0.8 while the engine is operating in the aforementioned predetermined mixture-leaning region or in a predetermined fuel cut effecting region, and it is set to 1.0 while the engine is operating in any other operating region. Therefore, whether or not the engine is operating in such predetermined mixture-leaning region or in such predetermined fuel cut effecting region can be determined by determining whether or not the value of the mixture-leaning coefficient KLS is 1.0. If the answer to the question of the step 6 is no, the value of the correction coefficient $KO_2$ is set to the mean value KREF, at the step 2, while if it is yes, the program then proceeds to execution of the feedback control of the fuel supply to the engine in a manner described later.

Preferably, the predetermined values of intake pipe absolute pressure and engine rpm for determination of the operating regions of the engine, shown in FIG. 4, such as the predetermined high speed operating region, are provided with hysteresis margins as indicated by the two parallel dotted lines in FIG. 4, so as to achieve stable operation of the engine. For example, the predetermined intake pipe absolute pressure PCAT (e.g. 200 mmHg) for determination of whether or not the engine has shifted between the fuel cut effecting region and the predetermined high speed operating region is provided with a hysteresis margin of ±5 mmHg with respect to a basic value of 200 mmHg. That is, the predetermined value PCAT is set to 205 mmHg to determine whether or not the engine has shifted from the fuel cut effecting region to the predetermined high speed operating region, whereas it is set to 195 mmHg to determine whether or not the engine has shifted from the latter region to the former region. Also, a predetermined engine rpm value NHOP for determination of shifting of the operating condition of the engine between the feedback control region and the predetermined high speed operating region is provided with a hysteresis margin of ±25 mmHg, so that it is set to 4,025 rpm and 3,975 rpm, respectively, to determine shifting of the operating condition of the engine from the feedback control region to the predetermined high speed operating region and vice versa.

Figure 5:
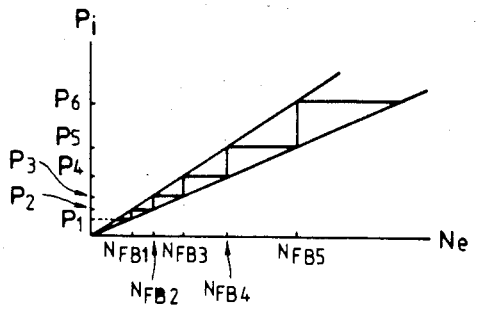
FIG. 5 is a view showing an Ne-Pi table for determining a correction value Pi for correcting the air/fuel ratio correction coefficient $KO_2$.

Referring again to FIG. 3, the manner of calculating the value of the correction coefficient $KO_2$ during the feedback control operation of the engine will now be explained. It is first determined whether or not there has occurred an inversion in the output level of the $O_2$ sensor, at the step 7. If the answer is affirmative, whether or not the previous loop was an open loop is determined at the step 8. If it is determined at the step 8 that the previous loop was not an open loop, the air/fuel ratio of the mixture is controlled by proportional term control (P-term control). More specifically, referring to FIG. 5 showing an Ne-Pi table for determining a correction amount Pi by which the correction coefficient $KO_2$ is corrected, five different predetermined Ne values $NFB_{1\text{-}5}$ are provided which fall within a range from 1500 rpm to 3500 rpm, while six different predetermined Pi values $P_{1\text{-}6}$ are provided in relation to the above Ne values, by way of example. Thus, the value of the correction amount Pi is determined from the engine rpm Ne at the step 9, which is added to or subtracted from the coefficient $KO_2$ upon each inversion of the output level of the $O_2$ sensor. Then, whether or not the output level of the $O_2$ sensor is low is determined at the step 10. If the answer is yes, the Pi value obtained from the table of FIG. 5 is added to the value of the coefficient $KO_2$, at the step 11, while if the answer is no, the former is subtracted from the latter at the step 12. Then, a mean value KREF is calculated from the value of $KO_2$ thus obtained, at the step 13. Calculation of the mean value KREF can be made by the use of the following equation:

$$KREF = \frac{CREF}{A} \times KO_{2p} + \frac{A - CREF}{A} \times KREF \qquad (7)$$

where $KO_{2p}$ represents a value of $KO_2$ obtained immediately before or immediately after a proportional term (P-term) control action, A a constant (e.g. 256), CREF a variable which is experimentally determined for each of these retions and set within a range from 1 to A−1, and KREF′ a mean value of values $KO_2$ obtained from the start of the first operation of an associated control circuit to the last proportional term control action inclusive.

Since the value of the variable CREF determines the ratio of the value $KO_{2p}$ obtained at each P-term control action, to the value KREF, an optimum value KREF can be obtained by setting the value CREF to a suitable value within the range from 1 to A−1 depending upon the specifications of an air/fuel ratio control system, an engine, etc. to which the invention is applied.

Figure 6:
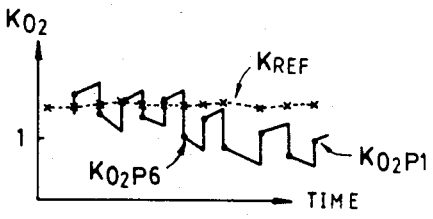
FIG. 6 is a graph showing a manner of detecting values of correction coefficients $KO_2p$ during proportional term control.

As noted above, the value KREF is calculated on the basis of a value $KO_2p$ obtained immediately before or immediately after each P-term control action. This is because the air/fuel ratio of the mixture being supplied to the engine occurring immediately before or immediately after a P-term control action, that is, at an instant of inversion of the output level of the $O_2$ sensor shows a value most close to the theoretical mixture ratio (14.7). Thus, a mean value of $KO_2$ values can be obtained which are each calculated at an instant when the actual air/fuel ratio of the mixture shows a value most close to the theoretical mixture ratio, thus making it possible to calculate a value KREF most appropriate to the actual operating condition of the engine. FIG. 6 is a graph showing a manner of detecting (calculating) the value $KO_2p$ at an instant immediately after each P-term control action. In FIG. 6, the mark . indicates a value $KO_2p$ detected immediately after a P-term control action, and $KO_2p1$ is an up-to-date value detected at the present time, while $KO_2P6$ is a value detected immediately after a P-term control action which is a sixth action from the present time.

Figure 7:
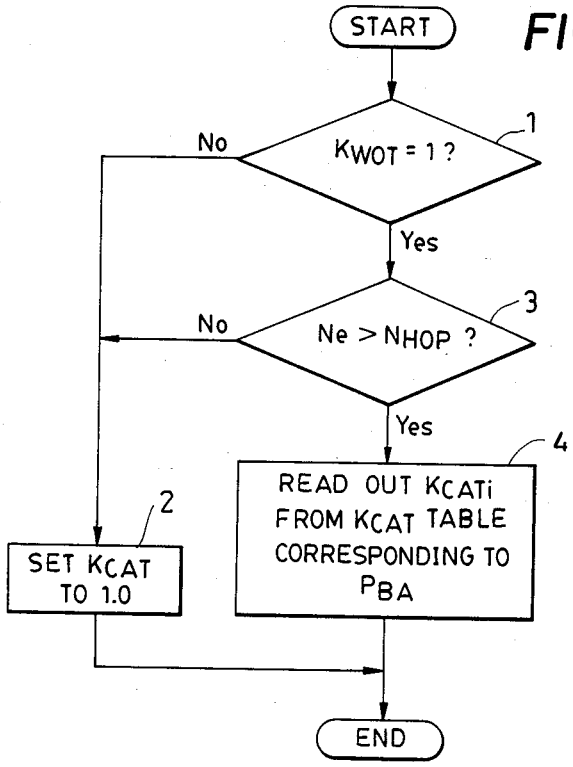
FIG. 7 is a flow chart of a subroutine for calculating the value of a correction coefficieent KCAT.
Figure 8:
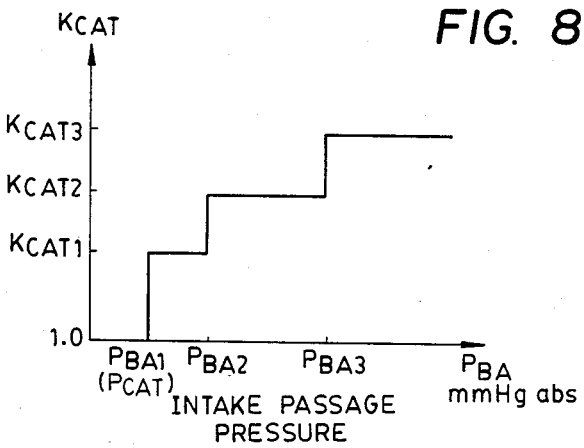
FIG. 8 is a graph showing the relationship between the value of the correction coefficient KCAT and the intake pipe absolute pressure PBA.

FIG. 7 shows a flow chart of a subroutine for calculating the value of the mixture-enriching correction coefficient KCAT. First, it is determined whether or not the mixture-enriching coefficient KWOT effectively applicable at wide-open-throttle of the engine assumes a value of 1.0, at the step 1. The negative answer to this question means that the engine is operating in the wide-open-throttle region in which the value of the correction coefficient KWOT is set to a value other than 1.0, e.g. 1.2. If the engine is operating in this wide-open-throttle region, the air/fuel ratio of the mixture being supplied to the engine is controlled to a ratio richer than a theoretical mixture ratio due to the application of the coefficient KWOT which is set to 1.2 as stated above, and accordingly there is no possibility of the bed temperature of the three-way catalyst exceeding its maximum allowable temperaure. Therefore, in this wide-open-throttle region, the value of the correction coefficient KCAT is set to 1.0 (step 2). If the answer to the question of the step 1 is yes, a determination is made as to whether or not the engine rpm Ne is larger than the aforementioned predetermined value NHOP for determination of engine operation in the predetermined high speed operating region, at the step 3. If the answer is no at the step 3, the step 2 is again executed to set the value of the coefficient KCAT to 1.0. On the other hand, if the answer is yes, the step 4 is now executed to read out a value KCATi of the coefficient KCAT corresponding to an actual value of the intake pipe absolute pressure PBA, from the ROM 507 in FIG. 2 in which a plurality of predetermined values of the coefficient KCAT are stored. The coefficient value KCATi is set as shown in FIG. 8, for example, such that it is maintained at 1.0 when the intake pipe absolute pressure PBA is below the predetermined pressure PCAT (e.g. 200 mmHg), and when the aboslute pressure PBA is above the predetermined value PCAT, it increases in a stepwise manner with an increase in the intake pipe absolute pressure PBA so as to prevent the bed temperature of the three-way catalyst from increasing above the maximum allowable temperature, taking into account the fact that the increase rate of the bed temperature of the three-way catalyst becomes larger with an increase in the load on the engine.

Alternatively of the correction coefficient KCAT, the mixture-enriching correction value TCAT may be employed to achieve the object of the invention, which is a term in the aforegiven equation (6) for calculating the correction value K2′ to be applied to the aforegiven equation (1′). Like the correction coefficient KCAT, predetermined values of the correction value TCAT may be stored in a storage means, which are set at suitable values as functions of the intake pipe absolute pressure PBA and are read out on the basis of the intake pipe absolute pressure PBA.

The value of the correction coefficient KCAT or the correction value TCAT thus obtained is applied together with the mean value KREF to calculation of the fuel injection periods of the fuel injection device, while the engine is operating in the predetermined high speed operating region.

Although in the foregoing embodiment, the fuel quantity metering device is formed by the fuel injection device 6, a carburetor may be employed as such fuel quantity metering device, instead.

Although in the foregoing embodiment the fuel supply quantity is controlled by varying the duration of application of a driving signal pulse to each injector, a fuel quantity metering device may alternatively be employed which is adapted to control the fuel supply quantity by varying the fuel pressure to be applied on the injector.

What is claimed is:

1. A method for controlling the quantity of fuel being supplied to an internal combustion engine having an intake passage and a catalytic means for purifying detrimental ingredients in exhaust gases emitted from the engine, in a feedback manner responsive to an output from a means for detecting the concentration of an ingredient in the exhaust gases so that the air/fuel ratio of an air/fuel mixture being supplied to the engine is controlled to a theoretical mixture ratio, said catalytic means being of the type being apt to most increase in bed temperature when the air/fuel ratio of the air/fuel mixture assumes said theoretical mixture ratio or a value close thereto, the method comprising the steps of: determining whether or not the engine is operating in a predetermined high speed operating region wherein the rotational speed of the engine is higher than a predetermined value which is a maximum value of the rotational speed of the engine above which the bed temperature of said catalytic means will exceed a predetermined maximum allowable value, if the air/fuel ratio of the air/fuel mixture being supplied to the engine is controlled to said theoretical mixture ratio or a value close thereto, and the absolute pressure in said intake passage is higher than a predetermined value; and (2) interrupting said feedback control and increasing the quantity of fuel being supplied to the engine by a predetermined amount, so that the resultant air/fuel mixture being supplied to the engine has an air/fuel ratio richer than said theoretical mixture ratio, when it is determined in said step (1) that the engine is operating in said predetermined high speed operating region, said predetermined amount being set to larger values as the absolute pressure in said intake passage increases.

2. A method as claimed in claim 1, wherein said predetermined value of the rotational speed of the engine in said step (1) is set to different values between when the operating condition of the engine enters said predetermined high speed operating region and when it leaves same.

3. A method as claimed in claim 1 wherein said predetermined value of the absolute pressure in said intake passage in said step (1) is set to different values between when the operating condition of the engine enters said predetermined high speed operating region and when it leaves same.

* * * * *